US006640803B2

(12) United States Patent
Davis et al.

(10) Patent No.: US 6,640,803 B2
(45) Date of Patent: Nov. 4, 2003

(54) OUTDOOR FIREPLACE

(75) Inventors: Mark E. Davis, Midland, GA (US); Eric Schmidt, New Braunfels, TX (US)

(73) Assignee: W.C. Bradley Company, Columbus, GA (US)

( * ) Notice: Subject to any disclaimer, the term of this patent is extended or adjusted under 35 U.S.C. 154(b) by 0 days.

(21) Appl. No.: 09/927,196

(22) Filed: Aug. 10, 2001

(65) Prior Publication Data

US 2003/0029442 A1 Feb. 13, 2003

(51) Int. Cl.[7] ..... F24B 1/181; F24B 1/192; F24B 1/195

(52) U.S. Cl. ..... 126/519; 126/304 R; 126/305; 126/306; 126/544; 126/277

(58) Field of Search ..... 126/500, 512, 126/304 R, 305, 306, 279, 277, 278, 58, 59, 25 R, 510, 511, 519, 544, 548, 551; D23/343, 348; D7/332, 337, 333, 334, 339

(56) References Cited

U.S. PATENT DOCUMENTS

| | | | | |
|---|---|---|---|---|
| 2,608,190 | A | * | 8/1952 | Winning et al. |
| 3,120,076 | A | * | 2/1964 | Zuch |
| 3,306,280 | A | * | 2/1967 | Vannoy |
| 3,339,540 | A | * | 9/1967 | Kreider ..... 126/535 |
| 3,396,715 | A | * | 8/1968 | Allen ..... 126/25 B |
| 3,809,051 | A | * | 5/1974 | Giroux |
| D242,860 | S | * | 12/1976 | Sutterby et al. ..... D23/342 |
| 4,167,177 | A | * | 9/1979 | Wiggins ..... 126/531 |
| D257,517 | S | * | 11/1980 | Francis ..... D23/350 |
| 4,285,327 | A | * | 8/1981 | Buckner et al. ..... 126/521 |
| 4,362,093 | A | * | 12/1982 | Griscom ..... 99/339 |
| D269,120 | S | * | 5/1983 | Francis ..... D23/343 |
| 4,489,706 | A | * | 12/1984 | Hait |
| D397,428 | S | * | 8/1998 | Reitsma et al. |
| 5,809,989 | A | * | 9/1998 | Nelson |

FOREIGN PATENT DOCUMENTS

| | | | | |
|---|---|---|---|---|
| CA | 2 201 452 | * | 10/1998 | ..... 126/519 |
| FR | 2574164 | * | 6/1986 | ..... 126/519 |
| FR | 2692969 | * | 12/1993 | ..... 126/519 |

* cited by examiner

*Primary Examiner*—Carl D. Price
(74) *Attorney, Agent, or Firm*—James W. Kayden; Thomas, Kayden, Horstemeyer & Risley, LLP

(57) ABSTRACT

An outdoor fireplace including a combustion chamber that has a top portion and an ash pan. The top portion and said ash pan are rigidly connected by a plurality of substantially vertical supports. The outdoor fireplace further includes a base, the base providing an upper portion and a support structure. The upper portion substantially spans the area spanned by the ash pan and is connected to the ash pan such that an integral airway is formed between the ash pan and the upper portion.

23 Claims, 3 Drawing Sheets

OUTDOOR FIREPLACE

FIELD OF THE INVENTION

The present invention generally relates to outdoor fireplaces and, more particularly, to an outdoor fireplace which preferably incorporates a multi-layer ash pan and improved access doors.

BACKGROUND

Outdoor fireplaces are often used to provide warmth, improve the ambiance of an outdoor setting, provide an open flame over which to cook, or to bum items as a means of disposal. Quite often, outdoor fireplaces are used on porches and decks which frequently have finished surfaces, such as wood, that can be readily discolored or damaged when exposed to elevated temperatures. In addition, prolonged exposure to moderate temperatures may be sufficient to cause damage. These problems are compounded by the fact that typical outdoor fireplaces have combustion chambers wherein the floor of the chamber is a single layer of metal, thereby allowing radiant heat from combustible materials to be readily transmitted to the surface underlying the outdoor fireplace. Further, due to safety concerns, it is desirable to maintain a low center of gravity, and thereby stability, for the outdoor fireplace and combustible materials being burned. Typical outdoor fireplaces are frequently designed such that the floor of the combustion chamber is supported only a short distance from the underlying support surface. This further contributes to the radiant transfer of heat to the underlying surface.

Therefore there is a need for providing improved outdoor fireplaces which address these and other shortcomings of the prior art.

BRIEF SUMMARY OF THE INVENTION

Briefly described, the outdoor fireplace provides an apparatus for burning combustible materials. An embodiment includes a combustion chamber that has a top portion and an ash pan. The top portion and said ash pan are rigidly connected by a plurality of substantially vertical supports. The outdoor fireplace further includes a base, the base providing an upper portion and a support structure. The upper portion substantially spans the area spanned by the ash pan and is connected to the ash pan such that an integral airway is formed between the ash pan and the upper portion.

Other objects, features, and advantages of the present invention will become apparent to one with skill in the art upon examination of the following drawings and detailed description. It is intended that all such objects, features, and advantages be included herein within the scope of the present invention, as defined in the appended claims.

BRIEF DESCRIPTION OF THE SEVERAL VIEWS OF THE DRAWINGS

The present invention, as defined in the claims, can be better understood with reference to the following drawings. The drawings are not necessarily to scale, emphasis instead being placed on clearly illustrating the principles of the present invention.

Figure 1:
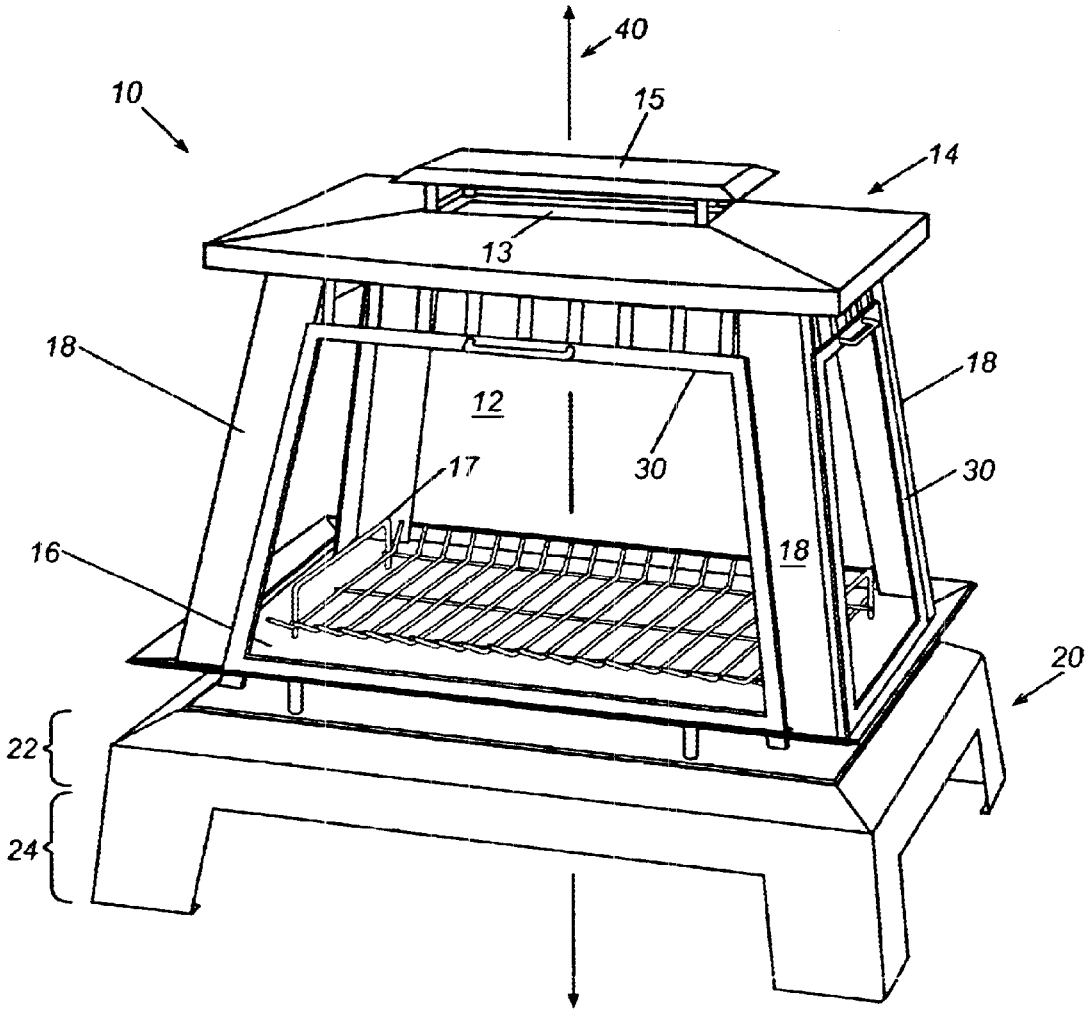
FIG. 1 is a perspective view of a preferred embodiment of the present invention.

Reference will now be made in detail to the description of the outdoor fireplace as illustrated in the drawings. While the outdoor fireplace will be described in connection with these drawings, there is no intent to limit it to the embodiment or embodiments disclosed therein. On the contrary, the intent is to cover all alternatives, modifications and equivalents included within the spirit and scope of the outdoor fireplace as defined by the appended claims.

DETAILED DESCRIPTION OF THE PREFERRED EMBODIMENTS

Figure 2:
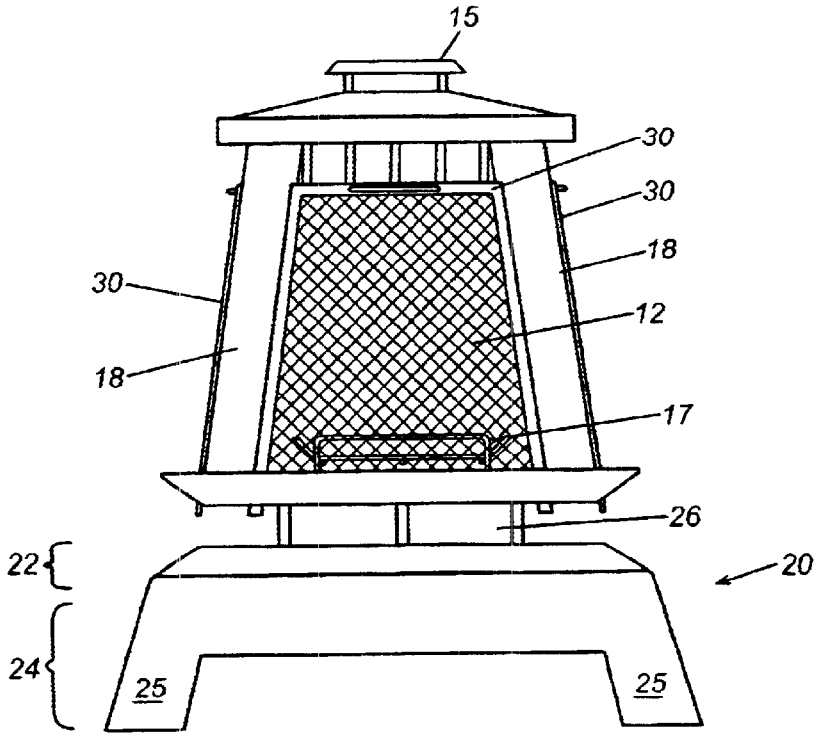
FIG. 2 is a side elevational view of the outdoor fireplace shown in FIG. 1.

Reference will now be made in detail to the description of the invention as illustrated in the drawings with like reference numerals indicating like parts throughout the several views. As shown in FIGS. 1 and 2, a preferred embodiment of the outdoor fireplace 10 of the present invention incorporates a combustion chamber 12 which includes a top portion 14 and an imperforate ash pan 16. The top portion 14 is rigidly attached to the base 20 by a plurality of substantially vertical supports 18, each vertical support 18 connecting a corner of the ash pan 16 to a corresponding corner of the top portion 14. As shown, the combustion chamber 12 is sufficiently sized and shaped for the placement of wood and/or other combustible materials. Note that while a rectangular embodiment of the outdoor fireplace of the present invention is shown, any number of different configurations are within the scope of the present invention.

As shown, the outdoor fireplace 10 further includes a base 20 having an upper portion 22 and a support structure 24. The ash pan 16 and the upper portion 22 are rigidly connected such that they lie in parallel horizontal planes, thereby forming an integral airway 26 between the combustion chamber and the base 20. With this construction, the upper portion 22 of the base acts as a radiant heat barrier, thereby lessening the amount of heat radiated from the combustion chamber 12 to the underlying support surface. Ideally, the upper portion 22 will have substantially the same shape and surface area as the ash pan 16 in order to maximize its effectiveness as a radiant heat barrier.

By preventing heat from radiating to the underlying surface, the heat from the combustion process is instead substantially maintained in the integral airway 26. Ambient airflow through the integral airway 26 dissipates the heat outwardly from the outdoor fireplace 10. In the embodiments revealed in the figures, the support structure 24 further includes support members 25 disposed such that ambient airflow is allowed between the upper portion 22 of the base 20 and the surface underlying the outdoor fireplace 10. This further reduces the potential for damage to occur to the underlying surface in that any potential heat buildup between the upper portion 22 and the underlying surface will be minimized.

A wire rack 17 can be provided so that the combustible materials are supported above the ash pan. This promotes more efficient combustion in that it allows air to flow more freely inside the combustion chamber 12 and around the combustible materials. As well, combustion is further enhanced in that spent matter falls away from the material that still remains to be burned and collects in the ash pan 16. It will be noted that the airflow within the combustion chamber 12 is separate and distinct from that airflow in the integral airway 26.

At least one access door 30 is provided in order to allow access to the combustion chamber 12 for the addition of burnable matter, tending the fire, etc. Preferably, an access door 30 is provided on each side of the outdoor fireplace 10 to allow maximum flexibility. In addition, the access doors 30 ideally allow fluid communication between the combustion chamber 12 and the ambient environment. As shown in FIGS. 1–5, the access doors 30 include portions of screen material, expanded material, etc., thereby allowing fluid communication with the ambient environment while at the same time preventing ashes and burning embers from leaving the combustion chamber 12. Although each of the access doors 30 shown allows fluid communication with the combustion chamber 12, this is not a requirement of the embodiments of the present invention. Embodiments are envisioned wherein the combustion chamber 12 has one or more imperforate walls and as few as one access door 30. The combustion chamber 12 merely needs enough air to support the combustion process. Note that the top portion 14 of the combustion chamber can include a vent orifice 13 disposed under a cover 15, the cover 15 preventing ashes and embers from leaving the combustion chamber 12, and preventing rain, etc., from entering the combustion chamber 12.

Figure 3:
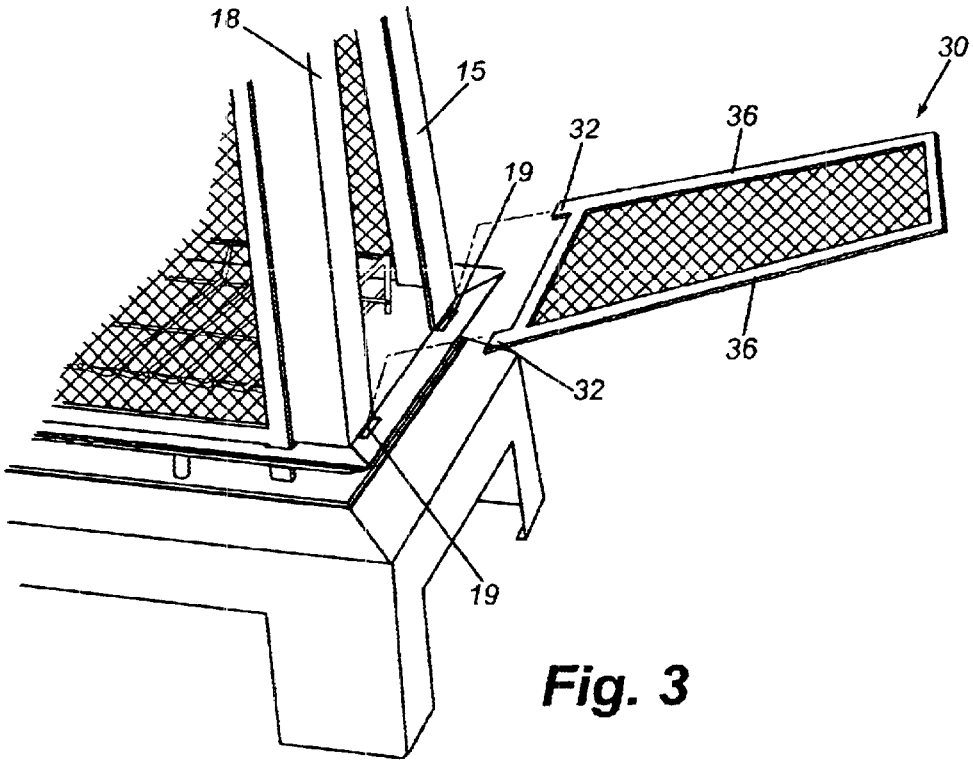
FIG. 3 is a partial perspective view of the outdoor fireplace shown in FIG. 2, showing removal of an access door.
Figure 4A:
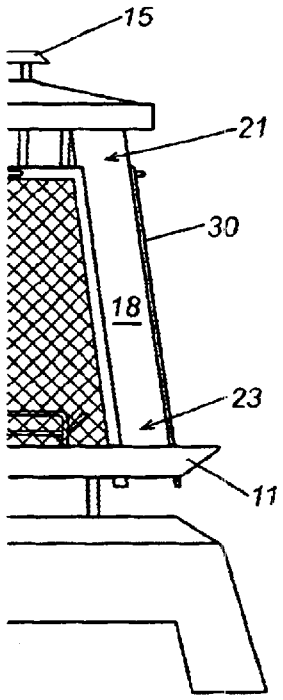
FIGS. 4A–4B are partial side elevational views of the outdoor fireplace of FIG. 3 showing an access door in an angled position.
Figure 4B:
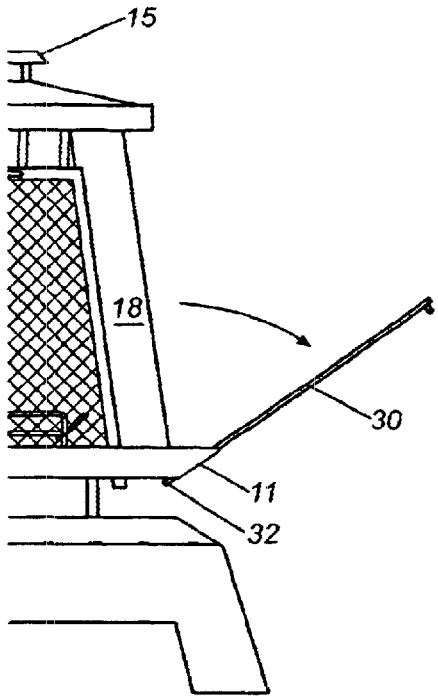

As shown in FIG. 3, the access doors 30 are preferably fully removable from the outdoor fireplace 10 and do not require a latch or like structure to secure them in position during operation. Each access door has at least one and preferably a plurality of pins 32 disposed along the bottom portion of the outer frame. These pins 32 are configured to align with corresponding apertures 19 formed in the ash pan 16, adjacent the periphery of the ash pan 16. To position the access door 30 for use, the pins 32 are inserted in the apertures 19 and the access door 30 is tilted inwardly until the side portions 36 of the outer frame contact an adjacent pair of substantially vertical supports 18. In the embodiment shown in FIGS. 4A and 4B, because the upper end 21 of each vertical support 18 is closer to the longitudinal, vertical axis 40 (FIG. 1) of the outdoor fireplace 10 than is the lower end 23 of the vertical support 18, the access door 30 is held in place by gravity.

To access the combustion chamber 12, an access door may be either fully removed (FIG. 3) or simply tilted away (FIG. 4B) from the vertical supports 18. When the access door 30 is tilted away from the vertical supports 18, the plurality of pins 32 remain in the apertures 19 of the ash pan 16, and the interaction limits the angular disposition of the access door 30 relative to the outdoor fireplace 10. Although two tab-shaped pins 32 of rectangular cross-section are disclosed, various other shapes for the pins 32, as well as numbers of pins 32 used, are within the scope of the present invention. As well, a skirt 11 can be provided around the periphery of the ash pan 16 that can be used to limit the angular disposition of the access door 30 along with the configuration of the pins 32 and corresponding apertures 19.

Figure 5A:
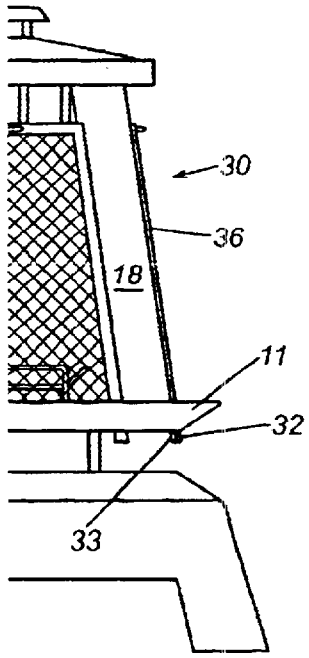
FIGS. 5A–5B are partial side elevational views of an embodiment of the present invention.
Figure 5B:
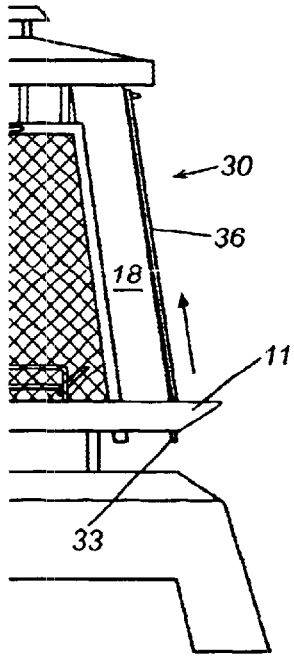

FIGS. 5A and 5B disclose a pin 32 and aperture 19 configuration whereby a downwardly extending surface 33 is positioned adjacent at least one of the apertures 19 corresponding to each access door. The downwardly extending surface 33 is configured such that the pin 32 inserted into the corresponding aperture 19 will be adjacent the downwardly extending surface 33 after the pin 32 has been inserted into the aperture 19. This configuration prevents any angular rotation of the access door 30, thereby insuring the side portions 36 of the outer frame of the access door 30 will be secured adjacent the substantially vertical supports 18. Because angular rotation of the access door 30 is prevented, the substantially vertical supports 18 can be vertical, or even tilted outward, as gravity is not required to hold the access door 30 in place.

The foregoing description has been presented for purposes of illustration and description. It is not intended to be exhaustive or to limit the invention to the precise forms disclosed. Obvious modifications or various are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

Therefore, having thus described the invention, at least the following is claimed:

1. An outdoor fireplace comprising:

a combustion chamber having a top portion, an ash pan and one or more access doors, each of said access doors having a plurality of pins disposed along a bottom portion of said access door, said top portion and said ash pan being connected by a plurality of substantially vertical supports, said ash pan including a plurality of orifices, said plurality of orifices being configured to receive said plurality of pins; and a base, said base having an upper portion and a support structure, said upper portion substantially spanning an area spanned by said ash pan, said upper portion and said ash pan being connected such that an integral airway is formed between said ash pan and said upper portions wherein at least one of said plurality of pins on each of said one or more access doors, after having been inserted in said plurality of orifices, is adjacent a surface of one of said substantially vertical supports extending downwardly from said ash pan such that said access door is secured adjacent two of said substantially vertical support.

2. The outdoor fireplace of claim 1, wherein a portion of said ash pan disposed within said combustion chamber is imperforate.

3. The outdoor fireplace of claim 2, wherein said upper portion is imperforate.

4. The outdoor fireplace of claim 2, wherein said ash pan and said upper portion are planar and are disposed in parallel horizontal planes.

5. The outdoor fireplace of claim 4, wherein said ash pan is rectangular.

6. The outdoor fireplace of claim 5, further including a wire rack disposed on said ash pan and configured for supporting combustible materials above said ash pan.

7. The outdoor fireplace of claim 1, wherein said support structure comprises a plurality of support members disposed such that an air passage is formed between said upper portion and an underlying support surface.

8. The outdoor fireplace of claim 1, wherein at least one of said one or more access doors is configured such that fluid communication between the environment surrounding said outdoor fireplace and said combustion chamber exists.

9. The outdoor fireplace of claim 8, wherein a portion of said at least one of said one or more access doors is a screen.

10. The outdoor fireplace of claim 9, wherein each of said one or more access doors includes a handle.

11. The outdoor fireplace of claim 1, wherein said plurality of orifices further comprises two orifices disposed on each side of said ash pan, each of said two orifices configured to receive one of said pins on each of said one or more access doors.

12. The outdoor fireplace of claim 1, wherein said substantially vertical supports are configured such that each of said one or more access doors is held in a position contacting two adjacent substantially vertical supports by force of gravity.

13. The outdoor fireplace of claim of claim 12, wherein said ash pan has a skirt adjacent a periphery of said ash pan, configured such that each of said one or more access doors can be tilted away from said substantially vertical supports, and supported by said skirt in an angled disposition relative to said substantially vertical supports, thereby allowing access to said combustion chamber.

14. The outdoor fireplace of claim 13, wherein said plurality of orifices further comprises two orifices disposed on each side of said ash pan, each of said two orifices configured to receive two pins on each of said one or more access doors.

15. The outdoor fireplace of claim 1, wherein said top portion further includes a vent orifice, said vent orifice being disposed beneath a cover.

16. The outdoor fireplace of claim 1, wherein said ash pan includes at least one orifice, said at least one orifice being configured to receive a corresponding at least one pin, said at least one pin being disposed along a bottom portion of said one or more access doors.

17. An outdoor fireplace comprising:

a combustion chamber having a top portion and an ash pan, said top portion having a vent orifice disposed beneath a cover, wherein said top portion and said ash pan are rectangular and rigidly connected by a plurality of substantially vertical supports, one each of said plurality of substantially vertical supports being positioned at a corner of said ash pan;

a base having an upper portion and a support structure, said upper portion being rectangular and connected to said ash pan such that an integral airway is formed between said upper portion and said ash pan, said support structure including a plurality of support members, one each of said support members being disposed at a corner of said upper portion such that an air passage is formed between said upper portion and an underlying support surface; and a plurality of access doors, each of said access doors including a pair of pins disposed on a bottom corner of said access door and configured to be received within a corresponding at least one orifice formed in said ash pan along a periphery of said ash pan, wherein a width of each of said access doors is greater than a width between adjacent of said substantially vertical supports;

wherein at least one of each of said pair of pins, after having been inserted in said corresponding at least one orifice, is adjacent a surface of one of said substantially vertical supports extending downwardly from said ash pan such that said access door is secured adjacent two of said adjacent substantially vertical supports.

18. The outdoor fireplace of claim 17, further including a skirt adjacent said periphery of said ash pan, said skirt extending upwardly and outwardly from said ash pan and configured such that said access door can be tilted outwardly from said substantially vertical supports and supported by said skirt in an angled disposition relative to said substantially vertical supports.

19. The outdoor fireplace of claim 18, wherein each of said substantially vertical supports includes a first end and a second end, said first end being connected to said ash pan and said second end is connected to said top portion, wherein said second end is closer to a central longitudinal axis of said outdoor fireplace than is said first end, such that each of said access doors is secured against adjacent of said vertical supports by gravity.

20. The outdoor fireplace of claim 19, wherein said at least one pin includes a pair of pins, one each of said pair of pins being disposed on a bottom corner of said access door.

21. The outdoor fireplace of claim 20, wherein each of said pair of pins comprises a planar structure and each of said at least one orifice is a slot configured to receive said planar structure.

22. An outdoor fireplace comprising:

a combustion chamber having a top portion, an ash pan and one or more access doors, each of said access doors having a plurality of pins disposed along a bottom portion of said access door, said top portion and said ash pan being connected by a plurality of substantially vertical supports, said ash pan including a plurality of orifices, said plurality of orifices being configured to receive said plurality of pins; and a base, said base having an upper portion and a support structure, said upper portion substantially spanning an area spanned by said ash pan, said upper portion and said ash pan being connected such that an integral airway is formed between said ash pan and said upper portion.

23. An outdoor fireplace comprising:

a combustion chamber having a top portion and an ash pan, said top portion having a vent orifice disposed beneath a cover, wherein said top portion and said ash pan are rectangular and rigidly connected by a plurality of substantially vertical supports, one each of said plurality of substantially vertical supports being positioned at a corner of said ash pan;

a base having an upper portion and a support structure, said upper portion being rectangular and connected to said ash pan such that an integral airway is formed between said upper portion and said ash pan, said support structure including a plurality of support members, one each of said support members being disposed at a corner of said upper portion such that an air passage is formed between said upper portion and an underlying support surface; and a plurality of access doors, each of said access doors including a pair of pins disposed on a bottom corner of said access door and configured to be received within a corresponding at least one orifice formed in said ash pan along a periphery of said ash pan, wherein a width of each of said access doors is greater than a width between adjacent of said substantially vertical supports;

wherein at least one of each of said pair of pins, after having been inserted in said corresponding at least one orifice, is adjacent a surface extending downwardly from said ash pan such that said access door is secured adjacent two of said adjacent substantially vertical supports.

* * * * *